US006721704B1

(12) United States Patent
Strubbe et al.

(10) Patent No.: US 6,721,704 B1
(45) Date of Patent: Apr. 13, 2004

(54) TELEPHONE CONVERSATION QUALITY ENHANCER USING EMOTIONAL CONVERSATIONAL ANALYSIS

(75) Inventors: Hugo J. Strubbe, Yorktown Heights, NY (US); Larry J. Eshelman, Ossining, NY (US); Srinivas Gutta, Buchanan, NY (US); John Milanski, Boulder, CO (US); Pelletier Daniel, Cortlandt Manor, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 276 days.

(21) Appl. No.: 09/941,013

(22) Filed: Aug. 28, 2001

(51) Int. Cl.[7] ..... G10L 11/00
(52) U.S. Cl. ..... 704/270; 379/88.01
(58) Field of Search ..... 704/270, 272, 704/276; 379/88.01

(56) References Cited

U.S. PATENT DOCUMENTS

| | | | | |
|---|---|---|---|---|
| 4,093,821 A | | 6/1978 | Williamson | |
| 4,142,067 A | | 2/1979 | Williamson | |
| 5,340,317 A | * | 8/1994 | Freeman | 434/321 |
| 5,596,634 A | | 1/1997 | Fernandez et al. | |
| 5,647,834 A | | 7/1997 | Ron | |
| 5,823,788 A | * | 10/1998 | Lemelson et al. | 434/350 |
| 6,480,826 B2 | * | 11/2002 | Pertrushin | 704/270 |
| 6,598,020 B1 | * | 7/2003 | Kleindienst et al. | 704/270 |

FOREIGN PATENT DOCUMENTS

| | | | |
|---|---|---|---|
| JP | 11154152 A | * | 6/1999 |
| JP | 11327590 A | * | 11/1999 |
| JP | 2000090087 A | * | 3/2000 |
| WO | WO9931653 | | 6/1999 |

* cited by examiner

*Primary Examiner*—Scott L. Weaver
(74) *Attorney, Agent, or Firm*—Gregory L. Thorne

(57) ABSTRACT

The present invention is a telephone conversation quality enhancer using an emotional conversational analyzer for analyzing the conversation between a primary party and a secondary party. Its focus is on improving the nature of the conversation quality by first analyzing the nature and quality of the conversation, determining how the analysis fits into a set of conversation conditions, and then determining what conversational aids may be used to assist in the enhancement of the conversation. The apparatus includes a microprocessor which communicates with the first and second telephone units and a database which stores conversational conditions and conversational aids. A conversation analyzer in the microprocessor analyzes the conversation occurring between the first and second telephone units and provides an analysis of the conversation. The microprocessor then applies the conversational conditions to the conversation analysis to select conversational aids. The conversation analyzer includes; a word detection algorithm to detect speech parameters such as the time words need to be spoken, loudness, pitch, intonation, number, rate and distribution of words spoken by each party; a speech recognition algorithm which searches for emotional keywords, and a conversational analysis module. The word detection algorithm and speech recognition algorithm each provide an output to the conversation analysis module which provides an analysis of the conversation. The analysis of the conversation is applied to the conversational conditions to determine which conversational aids may be displayed on a means for review by the speaker to enhance the conversation.

14 Claims, 1 Drawing Sheet

TELEPHONE CONVERSATION QUALITY ENHANCER USING EMOTIONAL CONVERSATIONAL ANALYSIS

BACKGROUND OF INVENTION

1. Field of the Invention

The invention relates to a telephone conversation quality enhancer using an emotional conversation analyzer. More specifically, the invention relates to apparatus for improving conversation quality by analyzing the nature and quality of the conversation and providing suggestions for improving the conversation.

2. Description of the Related Art

Speech analyzers for analyzing speech patterns to determine the emotional state of a speaker are well known in the art. Examples are shown in patents U.S. Pat. Nos. 4,093,821; 4,142,067; 5,647,834; and WO 9931653 (EP 1038291). These speech analyzers may be used in a telephone system to analyze the speech of a speaker on the phone. In addition, U.S. Pat. No. 5,596,634 discloses a telecommunication system for dynamically selecting conversation topics.

SUMMARY OF THE INVENTION

The present invention is a telephone conversation quality enhancer using an emotional conversational analyzer for analyzing the conversation between a primary party using a first telephone unit and a secondary party using a second telephone unit. Its focus is on improving the nature of the conversation quality by first analyzing the nature and quality of the conversation, determining how the analysis fits into a set of conversation conditions, and then determining what conversational aids may be used to assist in the enhancement of the conversation. The apparatus used to accomplish this is as follows. A microprocessor communicates with the first and second telephone units and a database which stores conversational conditions and conversational aids. A conversation analyzer in the microprocessor analyzes the conversation occurring between the first and second telephone units and provides an analysis of the conversation. The microprocessor then applies the conversational conditions to the conversation analysis to select conversational aids. The primary party has a means to review the conversation analysis and the conversational aids. The means for reviewing cooperates with the microprocessor to receive the conversation analysis and the conversational aids.

The conversation analyzer includes; a word detection algorithm to detect speech parameters such as the time words need to be spoken, loudness, pitch, intonation, number, rate and distribution of words spoken by each party; a speech recognition algorithm which searches for emotional keywords, and a conversational analysis module. The word detection algorithm and speech recognition algorithm each provide an output to the conversation analysis module which provides an analysis of the conversation. The analysis of the conversation is applied to the conversational conditions to determine which conversational aids may be displayed on the means for review by the speaker to enhance the conversation.

DETAILED DESCRIPTION OF THE INVENTION

Figure 1:
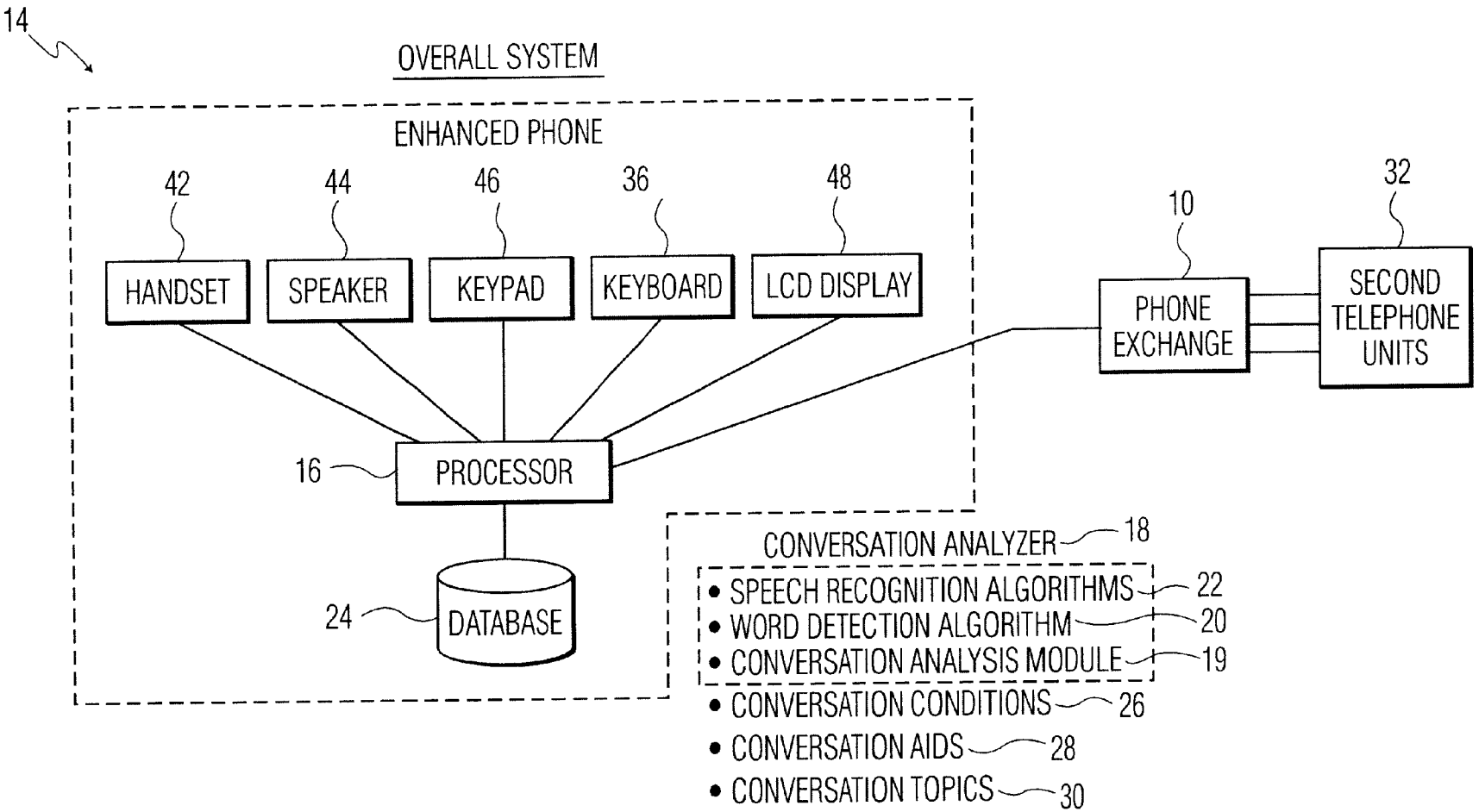
FIG. 1 shows a schematic drawing of the conversation quality enhancer using conversational analysis.

FIG. 1 shows a block diagram of the overall system for the conversation quality enhancer using conversational analysis.

Element 10 represents a connection to a phone exchange. For purposes of disclosure an enhanced telephone 14 will be the first telephone unit used by the primary party who is the user of the conversation quality enhancer. Enhanced telephone 14 contains a microprocessor 16 which performs all applications programs for enhanced telephone 14. The applications of the present invention are included in a conversational analyzer 18 which is composed of a conversation analysis module 19, a word detection algorithm 20 and a speech recognition algorithm 22. Microprocessor 16 is connected to an internal database 24 which maintains conversational conditions 26, conversational aids 28 and conversation topics 30. Conversation topics 30 may be entered from any of the input devices for microprocessor 16 at any time and downloaded to database 24. A second telephone unit 32 is connected to telephone exchange 10.

Examples of conversational conditions 26 would be boring, angry, stuck, berating, and upbeat. The characteristics of boring would be long pauses, primarily one party, little back and forth exchange. The characteristics of angry would be rapid fire exchange, emotional keywords ("hate", curse words, etc). The characteristics of stuck would be repeated keywords, phrases, frustration keywords (I already said that!). The characteristics of berating would be one party speaking rapid fire, the other using apologetic keywords ("sorry", "my fault"). The characteristics of upbeat would be rapid exchange, both parties involved, involved keywords ("cool", "exciting").

Examples of conversational aids 28 would be:

- Topic recommendations—News items, keywords that in previous conversations were associated with upbeat, involved conversations, events and entertainment info, suggestion for generic topics "family, religion, politics, etc.
- Warnings and advertisements—"Warning" "You are berating the other party", "This conversation appears boring", "You are speaking more angrily than the other party"
- Suggestions for alternate approaches—"Look for common ground", "Ask the other party's opinion", "include other person"—e.g. supervisor in a customer support call.
- Background music—soothing and/or stimulating music.
- Adjustment of line conditions—Lowering of volume or use of a volume compressor, notice and temporary suspension of transmission from one to the other ("You have 5 seconds to close and then your speaker will be temporarily turned off")

There are several methods for entering information (i.e. information entry devices) into microprocessor 16 and database 24. Keyboard 36 may be used by the primary party or other parties to enter information into the microprocessor 18 about conversation conditions 26, conversation aids 28, and conversation topics 30. Microprocessor 18 then enters the information into database 24. Microprocessor 16 further communicates with handset 42, speaker 44, keypad 46, and LCD display 48. These devices are all input/output (I/O) devices to microprocessor 16. Handset 42 is used by the primary party for speaking and listening in enhanced telephone system 14. Keypad 46 is used for dialing the secondary party caller with the second telephone unit 32. LCD display 48 is used by the primary party upon occurance of a telephone call between the primary or secondary party to display conversational aids 28 and conversational topics 30. Handset 42 is used by the primary party to provide information to microprocessor 16 through speech recognition algorithm 22. This type of speech information may also come from the second party caller This information is then entered into database 24.

In operation, a conversation occurring between the users of the first and second telephone units 14 and 32 is analyzed by the application programs of conversational analyzer 18 in microprocessor 16. When a primary party using the first telephone unit 14 is talking through exchange 10 to the secondary party of second telephone 22, the conversation is subject to word detection algorithm 20 in microprocessor 16 which detects speech parameters such as the time words need to be spoken, loudness, pitch, intonation, number, rate and distribution of words spoken by each party. In addition, the conversation is subjected to speech recognition algorithm 22 which searches for emotional keywords and phrases such as "idiot", "I love you" or "I hate you". Then the conversation analysis module 19 compares the rate of words spoken, the amount of words spoken by one party versus the other, and the emotional content of the words spoken. It uses this information to determine if the conversation is friendly, angry, well-paced, two-sided, etc. The microprocessor 16 then applies the results of the conversation analysis module 19 to the conversational conditions 26 which indicate which conversational aids 28 should be selected to improve conversation quality.

The conversation between the users of first and second telephones 14 and 22 is analyzed by conversational analysis module 19 for several factors. One of these factors is pacing. This is the analysis of the number, time words take to be spoken (i.e. speaking time v. silence time) and distribution of words spoken in comparison to silence. The analysis also includes fitting the number and distribution to conversation conditions 26 which are retrieved from database 24. A number of possible problems may be detected. First, a pattern of long pauses between speech suggests neither party knows what to say. In response conversation aids 28 would suggest conversation topics 30 from database 24, including benign topics like the weather, topical issues like news headlines, or more personal topics, like the primary party's favorite sport or activity. A second problem is a pattern of short pauses between words that continues for a long time. This suggests that the speaker is talking very slowly and perhaps the secondary party is tiring. This is an indicator of the problem with the primary parties own conversation and is likely to help the primary party realize that he needs to speed up. A third problem is a pattern of very little space between words. This suggests that the primary party is speaking too quickly and that the secondary party can not keep up and will tire easily. A slowdown indicator from conversational aids 28 is given to the primary user. A fourth problem may be a pattern of fast-paced exchanges, where both speakers are speaking simultaneously. This suggests an argument. Several approaches to cooling down the argument can be presented from conversational aids 28, including alternate approaches, soothing music or sounds, and benign topic suggestions. Affecting line quality such as introducing breaks in the line allows the parties to have a chance to cool down between outbursts. The line could also become one-way, allowing one speaker to speak uninterrupted until finished, then the other speaker would get to respond, uninterrupted.

A second factor analyzed by the conversational analysis module 19 is predominant speaker analysis. This analysis asks whether one speaker is dominating the conversation and whether the other speaker gets a chance to respond. Analysis, adjustment of line conditions, and other conversational aids 28 could mitigate one speaker predominating the other.

A third factor analyzed by the conversational analysis module 19 is emotional content. By analyzing emotional keywords and the words surrounding them, certain situations can be detected using conversational conditions 26. In addition, conversational analysis module 19 can determine if strong emotional components of the conversation are positive or negative and how they fit into conversational conditions 26. Suggestions for topics that respond to either state could be presented from conversational aids 28 or conversational topics 30. Suggestions from conversational aids 28 for outside services that could help (counseling, flowers, movies, etc.) could also be presented.

The invention is the combination of speech detection and recognition, conversation analysis, a database of conversational conditions and aids, a telephone (although not absolutely necessary) and an LCD display screen 40 or other device to communicate them to the primary or secondary user.

While the preferred embodiments of the invention have been shown and described, numerous variations and alternative embodiments will occur to those skilled in the art. Accordingly, it is intended that the invention be limited only in terms of the appended claims.

What is claimed is:

1. An emotional conversational analyzer that is configured to monitor a conversation between a primary party and a secondary party comprising:

a database that is configured to store a plurality of conversational conditions and corresponding one or more conversational aids, a conversation analyzer, operably coupled to the database, that is configured to analyze the conversation to identify a determined conversational condition of the plurality of conversational conditions, and a presentation device, operably coupled to the conversational analyzer and the database, that is configured to present the one or more conversational aids corresponding to the determined conversational condition to the primary party.

2. The emotional conversational analyzer of claim 1, further including at least one input device, operably coupled to the presentation device.

3. An emotional conversational analyzer that is configured to monitor a conversation between a primary party and a secondary party comprising:

a conversation analyzer that includes:

a word detection algorithm to detect speech parameters;

a speech recognition algorithm which searches for emotional keywords, and a conversational analysis module, the word detection algorithm and speech recognition algorithm each providing an output to the conversation analysis module which provides an analysis of the conversation.

4. The emotional conversational analyzer of claim 3, further including:

a database that is configured to contain a plurality of conversational conditions and corresponding conversational aids, and a rendering device that is configured to present one or more of the conversational aids corresponding to a determined conversational condition of the plurality of conversational conditions, based on the analysis of the conversation.

5. The emotional conversational analyzer of claim 4, wherein the rendering device is further configured to present the analysis of the conversation.

6. The emotional conversational analyzer of claim 4 in which the conversational aids include adjustment of line conditions.

7. The emotional conversational analyzer of claim 3 in which the speech parameters include the time words need to be spoken by each party.

8. The emotional conversational analyzer of claim 3 in which the speech parameters include loudness of words spoken by each party.

9. The emotional conversational analyzer of claim 3 in which the speech parameters include pitch of words spoken by each party.

10. The emotional conversational analyzer of claim 3 in which the speech parameters include intonation of words spoken by each party.

11. The emotional conversational analyzer of claim 3 in which the speech parameters include number of words spoken by each party.

12. The emotional conversational analyzer of claim 3 in which sad the speech parameters include rate of words spoken by each party.

13. The emotional conversational analyzer of claim 3 in which the speech parameters include distribution of words spoken by each party.

14. The emotional conversational analyzer of claim 3 in which the speech parameters include the time words need to be spoken, loudness, pitch, intonation, number, rate and distribution of words spoken by each party.

* * * * *

UNITED STATES PATENT AND TRADEMARK OFFICE

CERTIFICATE OF CORRECTION

PATENT NO. : 6,721,704 B1
APPLICATION NO. : 09/941013
DATED : April 13, 2004
INVENTOR(S) : Hugo J. Strubbe It is certified that error appears in the above-identified patent and that said Letters Patent is hereby corrected as shown below:

Section [75], should read: Boulder, CO (US) ; Daniel L. Pelletier

Signed and Sealed this

Twentieth Day of March, 2007

JON W. DUDAS
*Director of the United States Patent and Trademark Office*